US009201356B2

(12) United States Patent
Honda

(10) Patent No.: US 9,201,356 B2
(45) Date of Patent: Dec. 1, 2015

(54) FIXING DEVICE AND IMAGE FORMING APPARATUS

(71) Applicant: Oki Data Corporation, Minato-ku, Tokyo (JP)

(72) Inventor: Kentaro Honda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/174,005

(22) Filed: Feb. 6, 2014

(65) Prior Publication Data

US 2014/0227012 A1 Aug. 14, 2014

(30) Foreign Application Priority Data

Feb. 8, 2013 (JP) ..... 2013-023717

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/322, 400
See application file for complete search history.

(56) References Cited

U.S. PATENT DOCUMENTS 3,685,898 A * 8/1972 Gonzalez ..... 399/322
4,939,550 A * 7/1990 Takada et al. ..... 399/322
5,159,391 A * 10/1992 Koshi et al. ..... 399/316
5,166,737 A * 11/1992 Tomita ..... 399/400
5,285,245 A * 2/1994 Goto et al. ..... 399/322
5,374,949 A * 12/1994 Wada et al. ..... 347/112
5,477,314 A * 12/1995 Tsuchiya et al. ..... 399/107
5,519,477 A * 5/1996 Bell et al. ..... 399/307
5,579,097 A * 11/1996 Tomoe et al. ..... 399/323
5,812,920 A * 9/1998 Mizude et al. ..... 399/316
6,173,151 B1 * 1/2001 Ream et al. ..... 399/324
7,526,242 B2 * 4/2009 Takagaki et al. ..... 399/307
8,005,412 B2 * 8/2011 Sakashita et al. ..... 399/316
2002/0131801 A1 * 9/2002 Tomatsu ..... 399/400
2006/0099004 A1 * 5/2006 Hasegawa et al. ..... 399/92
2006/0182479 A1 * 8/2006 Miyake ..... 399/400
2007/0098472 A1 * 5/2007 Saeki et al. ..... 399/400
2007/0147920 A1 * 6/2007 Shimizu ..... 399/400
2008/0003025 A1 1/2008 Tsunoda
2009/0142113 A1 * 6/2009 Kajita et al. ..... 399/328
2012/0034004 A1 * 2/2012 Ishii ..... 399/322
2012/0057887 A1 * 3/2012 Kameda et al. ..... 399/44
2012/0230746 A1 * 9/2012 Namisaki et al. ..... 399/400
2013/0279953 A1 * 10/2013 Chikugo ..... 399/322
2014/0086644 A1 * 3/2014 Yasuda ..... 399/322

FOREIGN PATENT DOCUMENTS

JP 61097678 A * 5/1986 ..... G03G 15/20
JP 63008774 A * 1/1988 ..... G03G 15/20

(Continued)

*Primary Examiner* — David Bolduc
(74) *Attorney, Agent, or Firm* — Panitch Schwarze Belisario & Nadel LLP

(57) ABSTRACT

A fixing device for fixing processing to fix a developer to a medium where the developer is transferred onto the medium, according to the invention, includes: a fixing processing unit for the fixing processing of the medium fed from an upstream side in a medium conveyance direction; a medium guide unit for guiding the medium fed from the upstream side in a medium conveyance direction, to the fixing processing unit; and a conductive member having a relatively high conductivity, being connected to a ground level, and contacting to the medium guide unit.

7 Claims, 4 Drawing Sheets

(56) References Cited

FOREIGN PATENT DOCUMENTS

| | | | | |
|---|---|---|---|---|
| JP | 01154185 A * | 6/1989 | ..... | G03G 15/20 |
| JP | 2007-304199 A | | | 11/2007 |
| JP | 2008-096695 A | | | 4/2008 |
| JP | 2011-203756 A | | | 10/2011 |
| JP | 2012-189670 A | | | 10/2012 |

* cited by examiner

FIXING DEVICE AND IMAGE FORMING APPARATUS

CROSS REFERENCE TO RELATED APPLICATION

This application claims priority benefits under 35 USC, section 119 on the basis of Japanese Patent Application No. 2013-023717, the disclosure of which is incorporated herein by reference.

BACKGROUND OF THE INVENTION

1. Field of the Invention

This invention relates to a fixing device and an image forming apparatus and, more particularly, to a fixing device and an image forming apparatus such as, e.g., a photocopier, a printer, and a facsimile machine employing an electrophotographic method.

2. Description of Related Art

In image forming apparatuses such as photocopiers, printers, and facsimile machines employing conventional electrophotographic methods, respectively, for forming images, a photosensitive drum surface is generally charged with a charging roller, and electrostatic latent images are formed on the charged surface upon exposure from an LED head. With such a conventional image forming apparatus, toner images are formed to the electrostatic latent images formed on the photosensitive drum by clinging electrostatically a toner made into a thin layer on a developing roller, and the toner images are transferred to a recording medium by a transfer roller. Such a conventional image forming apparatus delivers to the exterior of the apparatus the recording medium after the toner images transferred to the recording medium are fixed by a fixing device.

With such a conventional fixing device, however, irregularity of electrostatic removal on the recording medium occurs, causing printing results to be worse.

It is therefore an object of the invention to provide a fixing device having less irregularity of electrostatic removal than the conventional device. It is another object of the invention to provide an image forming apparatus formed with the fixing device.

SUMMARY OF THE INVENTION

To solve the above problems, a fixing device for fixing processing to fix a developer to a medium where the developer is transferred onto the medium, in accordance with the invention, includes: a fixing processing unit for the fixing processing of the medium fed from an upstream side in a medium conveyance direction; a medium guide unit for guiding the medium fed from the upstream side in a medium conveyance direction, to the fixing processing unit; and a conductive member having a relatively high conductivity, being connected to a ground level, and contacting to the medium guide unit.

According to the invention, the fixing device and the image forming apparatus can be provided with a less amount of electrostatic removal irregularity on the recording medium.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF EMBODIMENTS

First Embodiment

Figure 2:
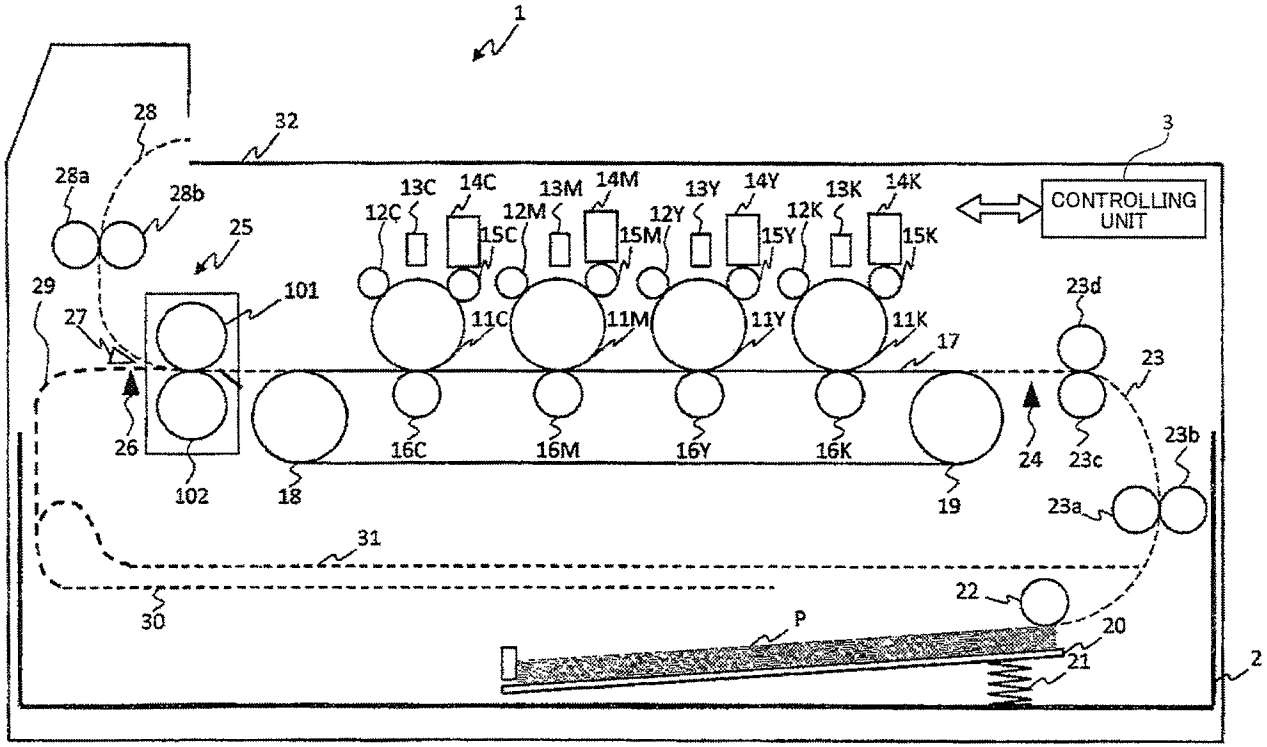
FIG. 2 is a schematic cross section showing an image forming apparatus according to the first embodiment of the invention.

Referring to drawings, a fixing device and an image forming apparatus according to the first embodiment of the invention are described in detail. First, the whole structure of the image forming apparatus 1 according to the first embodiment is described. FIG. 2 is a schematic cross section of the image forming apparatus 1 according to the first embodiment.

This image forming apparatus 1 is, e.g., a multicolor image forming apparatus of an electrophotographic method, capable of forming images on a recording medium P as a medium such as, e.g., printing paper made of plain paper or the like, using four color toners in black (hereinafter referred to as "K"), yellow (hereinafter referred to as "Y"), magenta (hereinafter referred to as "M"), and cyan (hereinafter referred to as "C").

In the image forming apparatus 1, respective devices are disposed within a housing including a frame 2. A controlling unit 3 executes various information processings and controls the respective devices in the image forming apparatus 1. Respective units in the image forming apparatus 1 are driven with electric power supplied from the electric power source unit 4 operating based on the control from the controlling unit 3. The image forming apparatus 1 is disposed with an image forming unit 10 for developing toner images in toner colors of K, Y, M, and C, respectively and for transferring the toner images to the recording medium P, and with a fixing device 25 for fixing the toner images to the recording medium P.

The image forming unit 10 includes photosensitive drums 11K, 11Y, 11M, 11C serving as image carriers of the respective toner colors, charge rollers 12K, 12Y, 12M, 12C for charging the photosensitive drums 11K, 11Y, 11M, 11C of the respective toner colors upon being fed of a high voltage from the electric power source unit 4, LED heads 13K, 13Y, 13M, 13C serving as exposing devices for forming electrostatic latent images on surfaces of the photosensitive drums 11K, 11Y, 11M, 11C upon exposing the charged photosensitive drums 11K, 11Y, 11M, 11C for respective toner colors, toner cartridges 14K, 14Y, 14M, 14C for storing toner agents of the respective toner colors, and supply rollers 15K, 15Y, 15M, 15C for supplying the toner agents of the toner cartridges 14K, 14Y, 14M, 14C to the electrostatic latent images formed on the photosensitive drums 11K, 11Y, 11M, 11C of the respective toner colors.

In the image forming unit 10, the photosensitive drums 11K, 11Y, 11M, 11C of the respective toner colors are arranged in tandem, and a transfer belt 17 is provided beneath those drums. A drive roller 18 and an idle roller 19 are disposed inside the transfer belt 17. The transfer belt 17 is held or namely tensioned by tensioning force from the drive roller 18 and the idle roller 19, and rotates according to the rotation of the drive roller 18 to convey the recording medium P.

Respective transfer rollers 16K, 16Y, 16M, 16C are disposed at positions facing the photosensitive drums of the respective colors astride the transfer belt 17, respectively, at the image forming unit 10. The transfer rollers 16K, 16Y, 16M, 16C of the respective colors are pressed toward the facing photosensitive drums 11K, 11Y, 11M, 11C. The transfer rollers 16K, 16Y, 16M, 16C of the respective colors holds the recording medium P conveyed on the transfer belt 17 in a sandwiching manner with the facing photosensitive drums 11K, 11Y, 11M, 11C, thereby transferring the toner images developed at the facing photosensitive drums 11K, 11Y, 11M, 11C to the recording medium P.

The recording media P are stocked on a support plate member 20 in the image forming apparatus 1. A hopping roller 22 is disposed for feeding the recording medium P into a conveyance path 23 above the recording medium P stacked on the support plate member 20. A spring 21 is disposed below the support plate member 20. The recording medium P stacked at the topmost position on the support plate member 20 is pushed up by this spring 21 and pressed toward the hopping roller 22. It is to be noted that, hereinafter, the upstream side and the downstream side in the conveyance direction of the recording medium or namely the medium conveyance direction are simply referred to as the "upstream side" and the "downstream side," respectively.

The conveyance path 23 is a path for conveying the recording medium P from the hopping roller 22 to the image forming unit 10 or namely the transfer belt 17. A pair of conveyance rollers 23*a*, 23*b* and a pair of conveyance rollers 23*c*, 23*d*, and a writing start sensor 24 for detecting arrivals of the recording media P are disposed along the conveyance path 23 from the upstream side sequentially.

In the image forming apparatus 1, the fixing device 25 is disposed on a downstream side of the image forming unit 10 or namely the transfer belt 17. The fixing device 25 is formed with a heating roller 101 and a pressing roller 102. The recording medium P is held in a sandwiching manner with the heating roller 101 and the pressing roller 102 in the fixing device 25, thereby applying heat and pressure to the recording medium P and feeding the recording medium P toward the downstream side.

A delivery sensor 26 and a switching blade 27 are disposed on a downstream side of the fixing device 25. Two conveyance paths 28, 29 branching off from each other are disposed on the downstream side of the fixing device 25. The switching blade 27 switches the conveyance direction of the recording medium P between the directions of the conveyance paths 28, 29 based on the control from the controlling unit 3.

The conveyance path 28 is a path for conveying the recording medium P delivered from the fixing device 25 up to a delivery tray 32. A pair of conveyance rollers 28*a*, 28*b* is disposed along the conveyance path 28.

Two branched conveyance paths 30, 31 are disposed on the downstream side of the conveyance path 29. The image forming apparatus 1 corresponds to a double side printing function for forming images on double sides of the recording medium P. That is, the image forming apparatus 1 has a structure supplying the recording medium P delivered from the fixing device 25 to the conveyance mechanism described above upon switching the switching blade 27 to a side of the conveyance path 29 described above when printing on the back side. For a brief description, in FIG. 2, conveyance rollers and switching blades along the conveyance paths 29, 30, 31 are omitted from the drawing. The recording medium P supplied to the conveyance path 29 is supplied to the conveyance path 31 as in a state of the upside down after held temporarily at the conveyance path 30. The recording medium P supplied to the conveyance path 31 is then supplied to the conveyance path 23 located on the upstream side of the image forming unit 10. That is, the conveyance path 31 is structured to feed the recording medium P from the conveyance path 30 to the conveyance path 23.

The controlling unit 3 can be structured of such as, e.g., a microprocessor, ROMs, RAMs, input and output ports, and timers. The controlling unit 3 controls respective portions by analyzing and operating information signals from respective sensors, and by making judgments with conditions to output operation instructive signals to the respective portions. More specifically, the controlling unit 3 performs processings of printing instructed images, as well as conveyance controls, charge controls, exposure controls, development controls, transfer controls, and fixing controls for recording medium P, thereby consequently making printing or image forming on the recording medium P.

Figure 1:
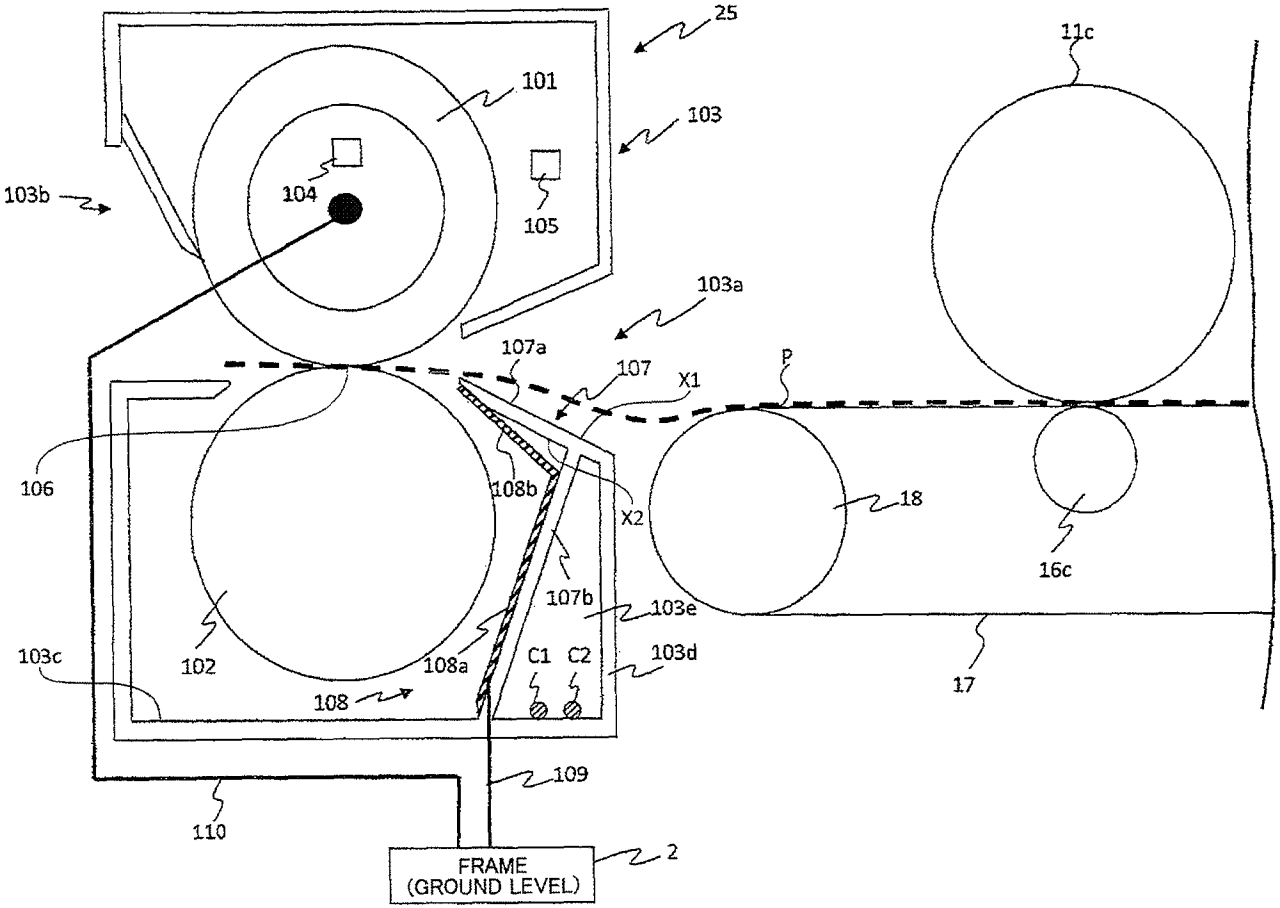
FIG. 1 is a schematic cross section showing a fixing device and its vicinity according to a first embodiment of the invention.

Next, referring to FIG. 1, the detailed description of the fixing device 25 is described. FIG. 1 is a schematic cross section showing the fixing device 25 and its vicinity according to the first embodiment.

As shown in FIG. 1, the fixing device 25 is formed, inside a chassis 103 serving as a housing, with the heating roller 101, the pressing roller 102, a heater 104, and a thermal sensor 105.

The heating roller 101 and the pressing roller 102 are disposed to press each other. The recording medium P is sandwiched at a nipping portion 106 at which the heating roller 101 and the pressing roller 102 are pressing each other, and is conveyed in a downstream side in application of pressure and heat. In other words, in the fixing device 25, the nipping portion 106 functions as a fixing processing unit for conducting fixing processing.

The heater 104 serving as a heat source is disposed within the heating roller 101, and the heating roller 101 is heated with the heater 104. The thermal sensor 105 is arranged near the heating roller 101. The thermal sensor 105 informs the controlling unit 3 of the measured temperature. The controlling unit 3 controls drive of the heater 104 so that the temperature measured by the thermal sensor 105 becomes a prescribed temperature.

An opening 103*a* is formed on the upstream side in the chassis 103 for receiving feeding of the recording medium P. An opening 103*b* is also formed on the downstream side in the chassis 103 for delivering the recording medium P. A conveyance guide 107, serving as a medium guide unit, is formed below the opening 103*a* for guiding the recording medium P entering in the fixing device 25 as to be proceeded precisely toward the nipping portion 106. In other words, the opening 103*a* is formed with the conveyance guide 107 on a lower side thereof, and the device 25 has a structure to guide or support the passing recording medium P from a lower side by the conveyance guide 107.

The chassis 103 is required to be formed of a material having a certain heat resistance. The chassis 103 may be made of a heat resistance resin such as, e.g., a glass fiber reinforced PET (polyethylene terephthalate) resin.

Figure 3:
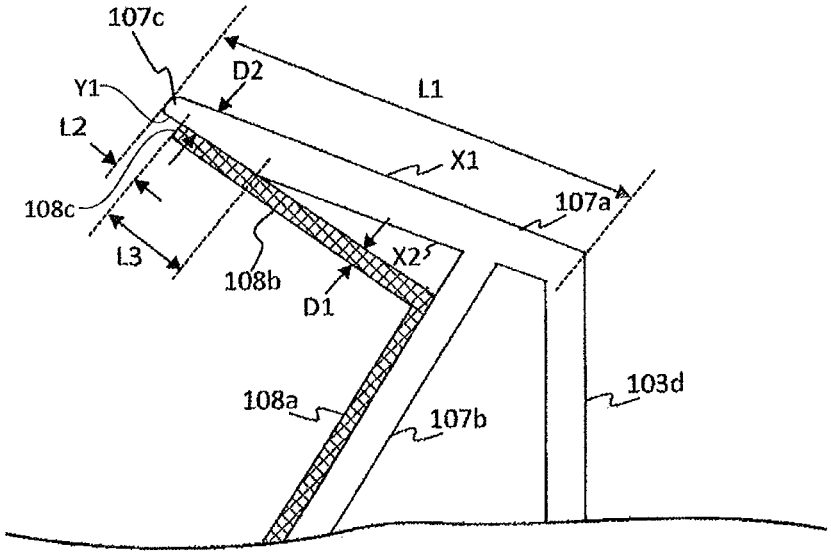
FIG. 3 is a schematic enlarged cross-sectional essential view showing in an enlargement manner a conveyance guide and a charge removal member according to the first embodiment of the invention.

FIG. 3 is a schematic enlarged cross-sectional essential view showing in an enlargement manner a portion of the conveyance guide 107.

The conveyance guide 107 is in a plate shape and is formed as a part of the chassis 103. More specifically, the conveyance guide 107 is formed as to stand upright from a bottom 103*c* of the chassis 103. The conveyance guide 107 also functions as a cover shielding the pressing roller 102 on the upstream side. The conveyance guide 107 is constituted of a guide portion 107*a* serving as a guide plate contacting the recording medium P, and a support portion 107*b* standing upright from the bottom 103*a* serving as a guide plate support for supporting the guide portion 107*a* from a lower side. It is to be noted that in this embodiment, exemplified is a structure in which the conveyance guide 107 (or namely the guide portion 107*a* and the support portion 107*b*) is formed in a united body with the chassis 103, or namely formed of the same material as that of the chassis 103.

In FIGS. 1, 3, a surface of the guide portion 107*a* contacting the recording medium P is shown as the "surface X1." In FIGS. 1, 3, a surface of the guide portion 107*a* on a lower side not contacting the recording medium P, or namely the opposite surface to the surface X1, is shown as the "surface X2." Furthermore, hereinafter, the downstream side in the medium conveyance direction when viewed with respect to the conveyance guide 107 is referred to as "inside," whereas the upstream side in the medium conveyance direction when viewed with respect to the conveyance guide 107 is referred to as "outside." The direction perpendicular to the medium conveyance direction on the medium conveyance path is referred to as the "width direction" or width direction of the conveyed recording medium P.

The chassis 103 is disposed with a cover 103*d* for covering the support portion 107*b* of the conveyance guide 107 from the outside thereof or the upstream side. In other words, the cover 103*d* is disposed as to shield from the end of the bottom 103*c* on the upstream side to the end of the guide portion 107*a* on the upstream side. A hole 103*e* penetrating the chassis 102 in the widthwise direction is formed between the cover 103*d* and the conveyance guide 107. This hole 103*e* can be utilized as a hole allowing, e.g., various wires or the like, shown as cross sections of wires C1, C2 in the example of FIG. 1, in the image forming apparatus 1 passing therethrough.

In FIG. 3, the length of the surface X1 in the medium conveyance direction is denoted as L1. As the length L1, it is favorable to set, e.g., around 20.3 mm. On a surface X2 of the guide portion 107*a*, a charge removing member 108, serving as a conductive member, for removing electrostatic charges built in the recording medium P contacting the guide portion 107*a* is disposed. A part of the charge removing member 108 contacts the guide portion 107*a*. As a charge removing member 108, a metal having a relatively high conductivity, such as iron, or aluminum, is desirably used. The guide portion 107*a* serving as the guide plate is made of a thermostable resin having a relatively high heat resistance. In FIG. 3, a plate thickness of the charge removing member 108 is denoted as D1. The thickness D1 is desirably set to, e.g., around 0.1 mm.

The charge removing member 108 is a metal plate having a cross section folded in a letter-L shape. At the charge removing member 108, a charge removing plate support 108*a* as another plate portion of the cross-sectionally L-shaped member is secured to an inner surface of the support portion 107*b* of the conveyance guide 107. In other words, in the charge removing member 108, a charge removing plate 108*b* for contacting the guide portion 107*a* is formed as extending from the support portion 108*a*. As shown in FIG. 3, an end 108*c* of the charge removing plate 108 is contacting the end 107*c* of the guide portion 107*a*.

The charge removing member 108 has the charge removing plate support 108*a* secured to the conveyance guide 107, but the charge removing plate 108*b* can be not secured to the conveyance guide 107 and can be structured as being merely pushed to the conveyance guide 107 by elastic force of the charge removing plate 108 as a metal plate.

As shown in FIG. 3, a slope Y1 of an inclination having a thickness gradually thinner as coming closer to the tip is formed on a side of the surface X2 at the end 107*c* of the guide portion 107*a*. Formation of this slope Y1 at the end 107*c* renders easy the uniform contact with the end 108*c* of the charge removing member 108, particularly, contact uniform in the widthwise direction.

In FIG. 3, a length from a portion staring the slope Y1 or the end of the slope Y1 on the upstream side, to the tip of the end 108*c* of the charge removing member 108 is denoted as "L3." That is, the end 108*c* of the charge removing member 108 and the end 107*c* of the guide portion 107*a* are in a contacting state with each other for the length of L3. In FIG. 3, a length from the tip or the end 108*c* of the charge removing member 108 to the tip or the end 107*c* of the conveyance guide 107 is denoted as "L2." That is, the tip or the end 108*c* of the charge removing member 108 is separated away from the tip or the end 107*c* of the guide portion 107*a* by the length of L2. In the FIG. 3, a thickness of the conveyance guide 107 or the end 107 around the tip or the end 108*c* of the charge removing member 108 is denoted as "D2." For the length L2, it is desirable to set around 0.5 mm. For the length L3, it is desirable to set around 5.8 mm. For the thickness D2, it is desirable to set around 0.5 mm.

The charge removing member 108 contacts an end of a lead wire 109 connected to a frame ground or the frame 2. Charges fed to the charge removing member 108 are flown entirely to the frame ground (namely the frame 2) and removed at all. In the fixing device 25, the heating roller 101 is also connected to a lead wire 110 connected to the frame ground or the frame 2. That is, the charge removing member 108 and the heating roller 101 are connected to the ground level. In the fixing device 25, therefore, the potentials of the charge removing member 108 and the heating roller 101 are maintained at the same level.

The surface X1 of the outside of the conveyance guide 107 forms an inner surface on a lower side of the opening 103*a* located on the upstream side of the chassis 103. As shown in FIGS. 1, 3, the surface X1 of the guide portion 107*a* is a slope of an inclination becoming gradually higher as proceeding from the upstream side to the downstream side. The tip of the guide portion 107*a* is disposed at substantially the same height as the nipping portion 106 serving as the destination of guidance for the recording medium P. When the recording medium P is supplied from the upstream direction, the level of the recording medium P is adjusted according to the guide of the guide portion 107*a*, and the recording medium P can be entered into the nipping portion 106 precisely. When the recording medium P passes through the guide portion 107*a*, the recording medium P is conveyed as the entire surface thereof being contacting or sliding the end 107*c* of the guide portion 107.

The fixing device 25 has a structure that charges built in the recording medium P including toner of the transferred toner images flow into the frame ground or the frame 2 via the charge removing member 108, when the recording medium P in a charged state, e.g., recording medium P during the second fixing processing in the double side printing, contacts the end 107*c* of the guide portion 107*a*.

It is desirable to maintain impedance (hereinafter referred to as "resistance value R") produced between double sides of the end 107*c* of the guide portion 107*a* or namely between the surface X1 and slope Y1 to be a degree capable of removing. This is for preventing the current due to high voltage applied to the transfer roller 16 from flowing into the frame ground or the frame 2. To prevent the current from leaking as described above, the above resistance value R is desirably adjusted to around $1\times10^{12}$ to $10^{14}$ Ohms per unit area (1 $cm^2$). There is no restriction on a method for adjusting the resistance value R, but various methods are applicable, for example, in which the inclination of the slope Y1 of the end 107*c* of the guide portion 107*a* is adjusted, in which a material of the guide portion 107*a* is adjusted (e.g., rendering metals, carbons, ion materials for providing conductivity more included), and in which a metal for providing a further conductivity to the surface is coated.

Next, the operation of the image forming apparatus 1 according to the first embodiment thus structured, is described. Hereinafter, a situation that the controlling unit 3 performs double side printing on the recording medium P is described.

First, the entire operation of the image forming apparatus is described. It is assumed that data of the printing job are fed to the controlling unit 3 from a host apparatus, not shown. The controlling unit 3 produces image signals printable at the image forming unit 10 based on the data of the printing job.

When receiving a printing instruction signal from a host controller such as a personal computer or the like connected to the image forming apparatus 1, the controlling unit 3 starts control on the fixing device 25 or namely the heater 104 and control the fixing device 25 at a usable temperature. When the fixing device 25 reaches the usable temperature, the controlling unit 3 operates a drive device not shown to rotate the photosensitive drums 11K, 11Y, 11M, 11C of the respective colors, thereby accelerating the rotation speed up to the speed of conveyance of the recording medium P at a time of printing. The controlling unit 3 controls rotational drive of the drive roller 18 at the same time, and rotates the transfer belt 17 by the drive roller 18, thereby accelerating the transfer belt 17 until the rotation speed of the transfer belt 17 reaches the conveyance speed of the recording medium P at a time of printing.

The controlling unit 3 controls the charge rollers 12K, 12Y, 12M, 12C and the photosensitive drums 11K, 11Y, 11M, 11C of the respective colors, thereby charging the photosensitive drums 11K, 11Y, 11M, 11C of the respective toner colors, or namely applying, e.g., a voltage around −600 V. The controlling unit 3 controls the LED heads 13K, 13Y, 13M, 13C of the respective toner colors to form electrostatic latent images on the photosensitive drums 11K, 11Y, 11M, 11C with exposure based on the produced image signals. The controlling unit 3 then controls such as the supply rollers 15K, 15Y, 15M, 15C of the respective toner colors, thereby developing the electrostatic latent images formed on the photosensitive drums 11K, 11Y, 11M, 11C with the toner agents.

The controlling unit 3 drives the hopping roller 22 and feeds the recording media P stacked on the support plate member 20 into the conveyance path 23. The controlling unit 3 subsequently drives the conveyance rollers 23*a*, 23*b*, and the conveyance rollers 24*a*, 24*b*, thereby supplying the recording medium P on the conveyance path 23 on the transfer belt 17.

The controlling unit 3 renders the recording medium P move on the transfer belt 17 while applying a transfer voltage such as, e.g., a voltage of 1500 V to 3000 V, to the transfer rollers 16K, 16Y, 16M, 16C corresponding to the respective toner colors. According to this voltage application, the toner images formed on the photosensitive drums 11K, 11Y, 11M, 11C of the respective toner colors receive Coulomb force by the plus voltage applied to the transfer rollers 16K, 16Y, 16M, 16C at the transfer nipping portions of the respective toner colors, and are transferred onto the recording medium P.

The controlling unit 3 supplies the recording medium P to which the toner images are transferred to the fixing device 25. The toners or toner images transferred onto the recording medium P are melt with heat and pressure at that time at the nipping portion 106 formed with the heating roller 101 and the pressure roller 102, and are fixed to the recording medium P by being discharged from the fixing device 25 thereafter and cooled.

The controlling unit 3 conveys and holds the recording medium P discharged from the fixing device 25 to the conveyance path 30 temporarily, and then supplies the medium P to the conveyance path 31 in an upside down state. The controlling unit 3 supplies the recording medium P fed to the conveyance path 31 further to the conveyance path 23 positioned on an upstream side of the image forming unit 10.

The controlling unit 3 performs transfer and fixing processings of the toner images with respect to the back side of the recording medium P by substantially the same processings as the above processing. When completing the fixing processing on the toner images on the back side, the controlling unit 3 controls the switching blade 27 and the like and supplies the recording medium P discharged from the fixing device 25 to the conveyance path 28. The controlling unit 3 then drives such as the conveyance rollers 28*a*, 28*b* to discharge the recording medium P out of the image forming apparatus 1 to place the medium on the delivery tray 32.

Charge removing operation for the recording medium P done at the guide portion 107*a* and the charge removing member 108 of the fixing device 25, where the image forming apparatus 1 forms images in a manner described above, is described next.

The recording medium P can be entered precisely into the nipping portion 106 where the medium's position is guided by the conveyance guide 107 at the opening 103*a* of the fixing device 25. At that time, the recording medium P is conveyed as contacting at least the end 107*c* of the guide portion 107 before entering into the nipping portion 106. In other words, the recording medium P uniformly contacts the end 107*c* of the guide portion 107*a* over the entire regions of the lower surface thereof prior to entering into the nipping portion 106. The charges built at the recording medium P as well as at the toner agents attached to the recording medium P are flown to the frame ground (the frame 2) via the charge removing member 108 (or namely the charge removing plate 108*b*) and the lead wire 109. The recording medium P thus is subject to charge removal upon contacting to the conveyance guide 107.

According to the first embodiment, the following advantages are obtainable. The image forming apparatus according to the first embodiment realizes charge removal done by contacting the guide portion 107*a* with the recording medium P uniformly. With the art described in such as, e.g., Japanese Patent Application Publication No. 2011-203756 (A1), charge removal is made by contacting a charge removing blush with the recording medium. In such a case, charge removal may be done irregularly, e.g., some extraordinarily charged region may remain, because regions contacting the charge removing blush and regions not contacting the charge removing blush occur at the recording medium. To the contrary, with the image forming apparatus 1, it is structured that charge removal is made in contacting uniformly the recording medium P at all the position in the widthwise direction by means of the guide portion 107*a*, so that irregularity of charge removal hardly occurs in comparison with prior arts. Accordingly, the image forming apparatus 1 can prevent any extraordinarily charged region from occurring because, with the fixing device 25, the region entering into the nipping portion 106 or the vicinity of the region contacting the conveyance guide 107, in the recording medium P, is subject to charge removal uniformly and enters in a state having no irregularity on charge removing. With this structure, the fixing device 25 can prevent the toner images or toner images before fixing processing from broken due to such as, e.g., discharges or namely discharges between the recording medium P and the heating roller 101.

The fixing apparatus 25 can keep the potentials of the conveyance guide 107 and the heating roller 101 to be the same levels by connecting the heating roller 101 to the frame ground or the namely the frame 2. That is, in the fixing device 25, the region entering into the nipping portion 106 or the vicinity of the region contacting the conveyance guide 107, in the recording medium P, is maintained to have substantially the same potential as that of the heating roller 101. With this structure, the fixing device 25 can further prevent any discharge from occurring between the recording medium P and the heating roller 101.

With the image forming apparatus 1, where the fixing device 25 performs the fixing processing, more charges may be built in the recording medium P. This is because the recording medium P is charged from such as triboelectricity between the heating roller 101 and the pressure roller 102. There also raises a problem such that the recording medium P enters into a state prone to more readily charging because water evaporates where the recording medium P is subject to the heating processing. It is therefore important from a view to such as printing quality to remove charges from the recording medium P before the second fixing processing in the image forming apparatus 1.

With the image forming apparatus 1 of the first embodiment, a structure is realized in which the charge removing member 108 is electrically connected with the recording medium P without directly contacting the recording medium P. In other words, the image forming apparatus 1 is structured such that the charge removing member 108 electrically, indirectly connects the recording medium P via the guide portion 107*a*. With this structure, the charge removing member 108 electrically connects the recording medium P via the proper impedance or electrical resistance generated from the guide portion 107*a*, thereby obtaining advantages such as stable charge removal and damage prevention on the toner images. For example, according to the length of the recording medium P in the medium conveyance direction, the fixing device 25 may performs the fixing processing at a downstream region or at a region at which transfer of the toner images with the image forming unit 10 finishes, while the image forming unit 10 transfers the toner images at an upstream region. In such a situation, the recording medium P contacts the guide portion 107*a* at the region on the downstream side, while the recording medium P contacts the transfer roller 16C provided on the downstream side. The transfer roller 16C applied with the high voltage feeds the high voltage to the recording medium P at that time. If the current caused by the high voltage leaks into the frame ground or the frame 2 via the charge removing member 108 from the recording medium P, the current may damage the toner images transferred onto the recording medium P or namely the toner image not yet subject to the fixing processing, thereby possibly affecting the printing quality. Particularly, under a high temperature circumstance, water contained in the recording medium P reduces the electric resistance, thereby making the current flow easily. With the image forming apparatus 1, such current leakage from the transfer roller as described above can be prevented by connecting the recording medium P electrically via the proper impedance or electric resistance generated by the guide portion 107*a*.

It is to be noted that a resistor may be inserted between the charge removing member 108 and the frame ground or the frame 2 to stop current leakage from the transfer roller, but diversion of the conveyance guide 107 originally disposed for functioning a guidance for the recording medium P may realize cost reduction of the fixing device 25.

The chassis 103 of the fixing device 25 is formed with the cover 103*d* shielding the further outside of the conveyance guide 107 thus structured. With this cover 103*d*, air in a space or the hole 103*e* produced between the cover 103*d* and the conveyance guide 107 brings thermal preservation effect (or heat insulation effect) in which the heat inside the fixing device 25 is preserved or insulated. In addition, the image forming apparatus 1 can pass necessary wires through this hole 103*e*, so that the space inside the image forming apparatus 1 can be utilized effectively.

Second Embodiment

Hereinafter, a fixing device and an image forming apparatus according to the second embodiment of the invention are described in reference with FIG. 4. For the sake of simplicity, only those different from the first embodiment are described for the image forming apparatus 1A of the second embodiment. In the second embodiment, what is different is a fixing device 25A only, and hereinafter, only the fixing device 25 is described in reference with FIG. 4.

Figure 4:
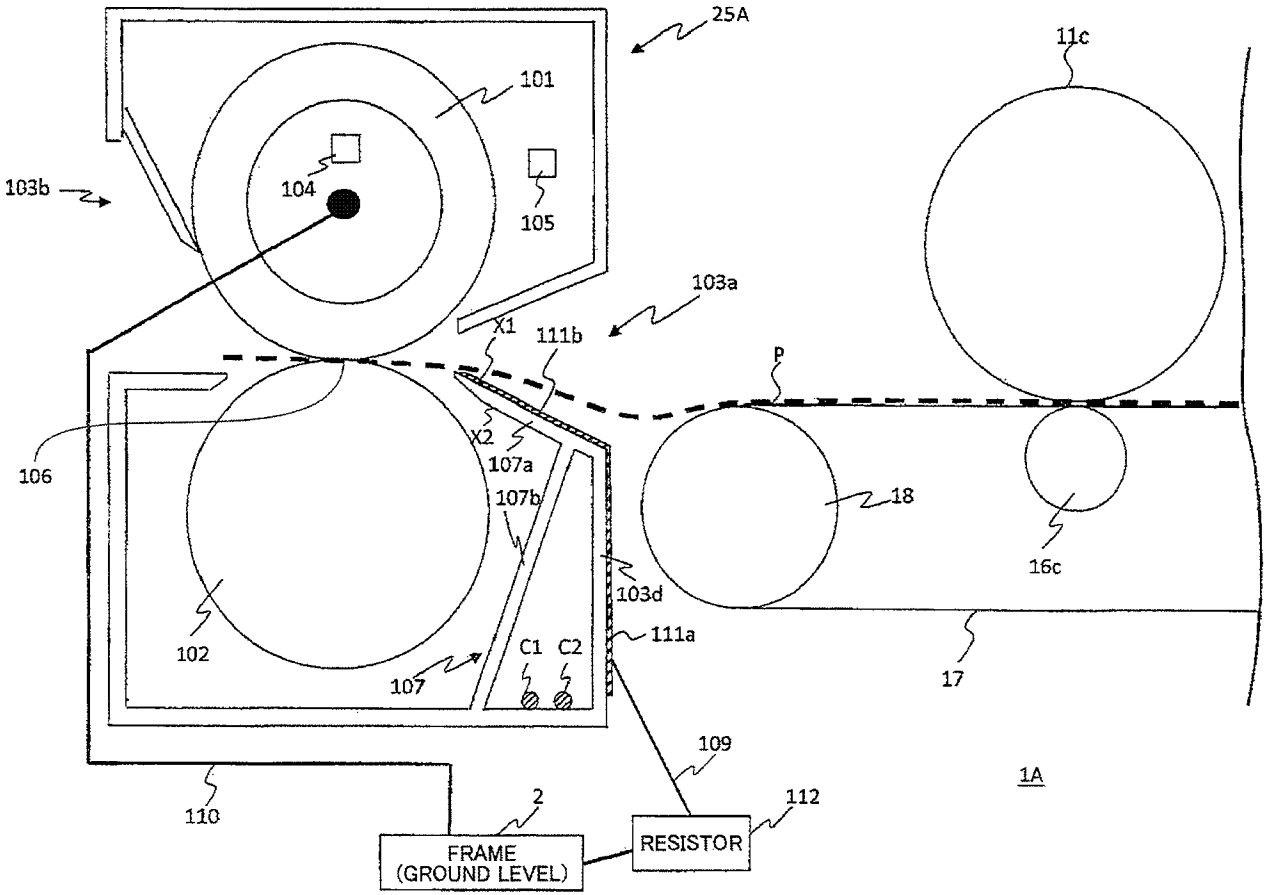
FIG. 4 is a schematic cross section showing a fixing device and its vicinity according to a second embodiment of the invention.

FIG. 4 is a schematic cross section showing structures of the fixing device 25A according to the second embodiment and its vicinity. In the second embodiment, as shown in FIG. 4, it is different from the first embodiment in having a structure that a charge removing plate 111 is disposed on a surface X1 on an outside of the conveyance guide 107.

The charge removing plate 111 is disposed as to shield a region from the surface X1 outside the conveyance guide 107 to a surface outside the cover 103*d*. The charge removing plate 111 is connected to the frame ground or the frame 2 via the lead line 109. That is, in the second embodiment, the charge removing plate 111 directly contacts the recording medium P, guides the recording medium P, and further removes charges from the recording medium P. In the first embodiment, the charge removing member 108 is electrically connected to the recording medium P indirectly via the conveyance guide 107, so that the leaking current from the transfer roller is suppressed by production of the proper impedance at the conveyance guide 107. To the contrary, with the second embodiment, a resistor 112 is inserted between the charge removing plate 111 and the frame ground or the frame 2 because the charge removing plate 111 directly contacts the recording medium P and removes the charges form the recording medium P. It is desirable to set the resistance value to be 100 M ohms or more between the charge removing plate 111 and the frame ground or the frame 2, as a resistance value of the resistor 112, and it is further desirable to set the resistance value comparable to the resistance value R shown in the first embodiment.

With such a second embodiment, the following advantages are obtainable. In the second embodiment, the position of the charge removing plate 111 is changed to be outside, but the plate 111 can remove charges of the recording medium P before the recording medium P enters into the nipping portion 106 of the fixing device 25A in substantially the same way as in the first embodiment.

In the second embodiment, the resistor 112 is inserted between the charge removing plate 111 and the frame ground or the frame 2, so that the fixing device 25A can suppress the current leakage from the transfer roller in substantially the same way as in the first embodiment.

Other Embodiments

This invention is not limited to the embodiments described above, but can be modified as exemplified as follows.

In the above embodiments, the examples in which the fixing device and the image forming apparatus according to the invention are applied to the printers are described, but the apparatuses to which this invention is applicable are not limited to those. For example, the image forming apparatus according to the invention is applicable to various image forming apparatuses such as, e.g., monochrome printers or namely printers having a monochrome toner black or white, multicolor photocopiers, and facsimile machines.

In the above embodiments, the fixing processing is made at the nipping portion 106 between the heating roller and the pressure roller, this structure may be replaceable with other fixing processing mechanisms. For example, it is replaceable with a mechanism for performing the fixing processing upon heating an endless type fixing belt and sandwiching the recording medium at a nipping portion formed between the fixing belt and the pressure roller.

The inner surface of the charge removing member 108 or the surface facing the pressure roller 102 may be subject to a fabrication for promoting thermal reflection such as, e.g., mirror finishing processing in the first embodiment. This fabrication improves temperature preservation effect or heat insulation effect in the chassis 103 of the fixing device 25.

In the first embodiment, no resistor is inserted between the charge removing member 108 and the frame ground or the frame 2, but an element such as, e.g., a resistor in substantially the same way as in the second embodiment may be inserted to adjust the impedance or resistance value between the charged recording medium P and the frame ground or the frame 2.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A fixing device for fixing processing to fix a developer to a medium where the developer is transferred onto the medium, the fixing device comprising:

a fixing processing unit for the fixing processing of the medium fed from an upstream side in a medium conveyance direction;

a medium guide unit for guiding the medium fed from the upstream side in a medium conveyance direction, to the fixing processing unit, the medium guide unit having a first surface that contacts the medium and a second, opposing surface;

first and second rotating bodies located downstream of the medium guide unit and configured to nip the medium; and a conductive member having a relatively high conductivity, being connected to a ground level, and in contact with the second surface of the medium guide unit along a predetermined length extending in the medium conveyance direction from a first contact end to a second contact end downstream of the first contact end, wherein the medium guide unit has a first thickness measured between the first and second surfaces at the first contact end that is greater than a second thickness measured between the first and second surfaces at the second contact end, the first thickness being greater than 0.5 mm, wherein an end of the conductive member is positioned so as to be recessed by a predetermined distance from an end of the medium guide unit over which the medium passes, and wherein the second thickness is 0.5 mm.

2. The fixing device according to claim 1, wherein the end of the conductive member is located at the second end of the predetermined length, and is located vertically above the second rotating body.

3. The fixing device according to claim 2, wherein the medium guide unit has a support portion extending below the second rotating body, wherein the conductive member has a folded portion located remotely from the end of the conductive member, and wherein the conductive member extends below the second rotating body as the folded portion approaches the support portion.

4. The fixing device according to claim 3, wherein the folded portion adjacent to the support portion extends above a contact position of a vertical tangential line to a surface of the second rotatable body.

5. The fixing device according to claim 4, wherein the conductive member is slanted from the folded portion adjacent to the support portion toward the end of the conductive member in contact with the medium guide.

6. The fixing device according to claim 5, wherein a shortest distance between the folded portion adjacent the support portion and the surface of the second rotatable body is greater than a shortest distance between the contact position on the surface of the second rotatable body and the portion of the conductive member extending from the folded portion.

7. The fixing device according to claim 6, wherein the conductive member has a surface having a mirror finish opposite to the second rotating body.

* * * * *